US011213964B2

(12) United States Patent
Lauritsen

(10) Patent No.: US 11,213,964 B2
(45) **Date of Patent: *Jan. 4, 2022**

(54) PROGRAMMABLE HAIR TRIMMING SYSTEM

(71) Applicant: KONINKLIJKE PHILIPS N.V., Eindhoven (NL)

(72) Inventor: Klaus Lauritsen, Vejle (DK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,079

(22) Filed: Aug. 11, 2020

(65) Prior Publication Data

US 2020/0368926 A1 Nov. 26, 2020

Related U.S. Application Data

(63) Continuation of application No. 14/397,869, filed as application No. PCT/DK2013/050105 on Apr. 15, 2013, now Pat. No. 10,773,400.

(30) Foreign Application Priority Data

May 1, 2012 (DK) ..... PA201200292

(51) Int. Cl.
*B26B 19/38* (2006.01)
*B26B 21/40* (2006.01)

(52) U.S. Cl.
CPC ..... *B26B 19/388* (2013.01); *B26B 21/4081* (2013.01); *Y10T 83/148* (2015.04); *Y10T 83/155* (2015.04)

(58) Field of Classification Search
CPC ... B26B 19/388; B26B 21/4081; B26B 19/00; Y10T 83/148; Y10T 83/155
See application file for complete search history.

(56) References Cited

U.S. PATENT DOCUMENTS 2,941,293 A * 6/1960 Mazzoni ..... B26B 19/20 30/201
3,272,209 A 9/1966 Kraus
3,413,985 A * 12/1968 Dlouhy ..... B26B 19/00 132/213
4,614,036 A * 9/1986 Haraguchi ..... B26B 19/205 30/200
5,204,599 A * 4/1993 Hohn ..... G05B 19/4103 318/571
7,628,161 B1 * 12/2009 LoSauro ..... A45D 24/36 132/200
7,992,307 B2 8/2011 Smal
(Continued)

FOREIGN PATENT DOCUMENTS

GB 2462812 2/2010

OTHER PUBLICATIONS

Merriam-Webster, Point, available on Apr. 1, 2019 at https://www.merriam-webster.com/dictionary/point.

*Primary Examiner* — Jonathan G Riley

(57) ABSTRACT

A hair trimming device arranged to detect positions of the hair trimming device in relation to a client's head and to adjust its trimming length automatically and dynamically according to preprogrammed values at any given point during a hair trimming session.

20 Claims, 13 Drawing Sheets

(56) References Cited

U.S. PATENT DOCUMENTS

Figure 1A:
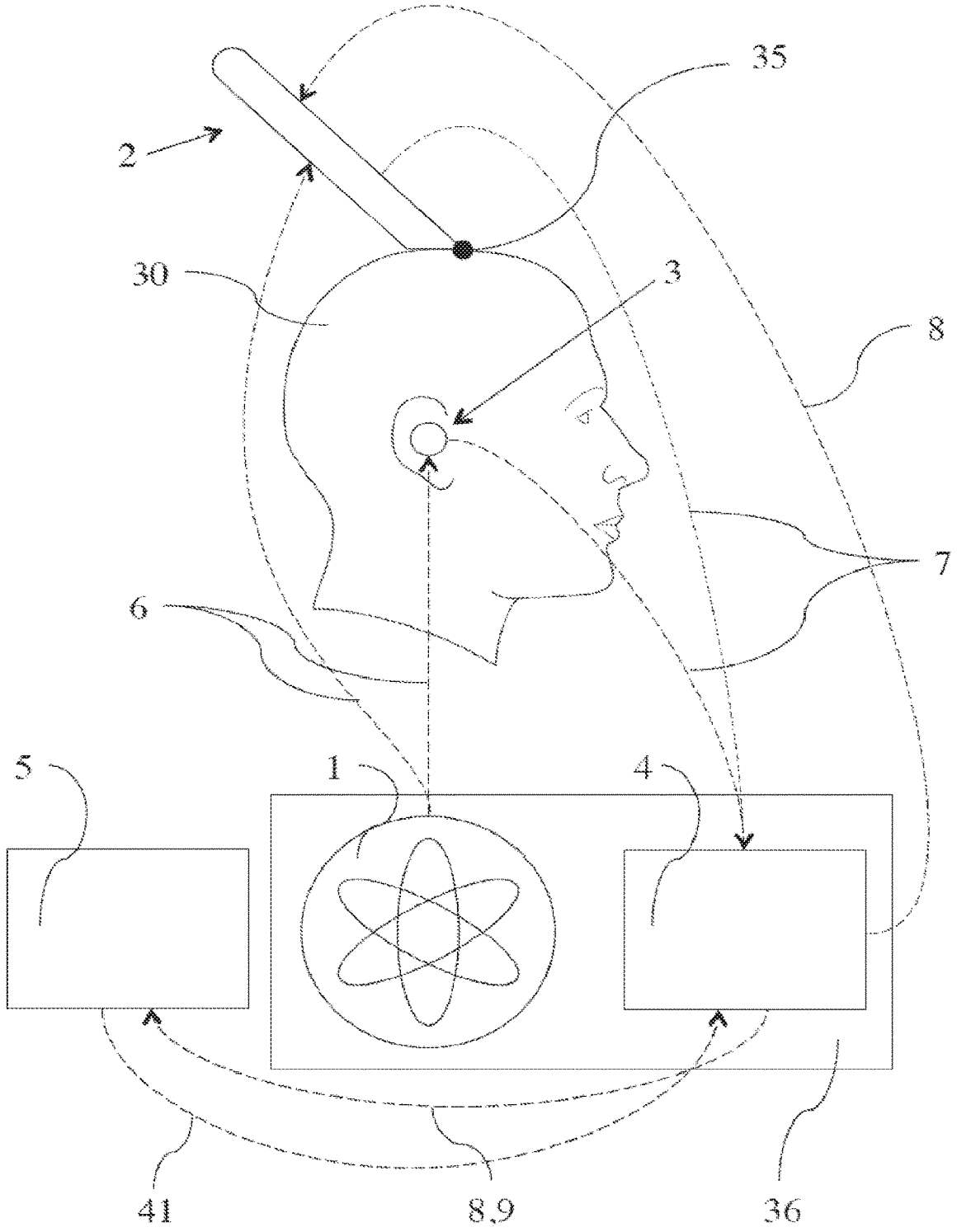

| | | | | |
|---|---|---|---|---|
| 2004/0004559 | A1* | 1/2004 | Rast | G06F 3/002 341/34 |
| 2008/0154247 | A1* | 6/2008 | Dallarosa | A61B 18/203 606/3 |
| 2009/0278495 | A1* | 11/2009 | Kaye | H02J 7/0027 320/114 |
| 2011/0018898 | A1 | 1/2011 | Zhu | |
| 2012/0234146 | A1* | 9/2012 | Lakin | B26B 19/00 83/76.2 |
| 2014/0200734 | A1* | 7/2014 | Krenik | G05B 15/02 700/302 |
| 2015/0059187 | A1* | 3/2015 | Krenik | B26B 19/42 30/123 |
| 2015/0197016 | A1* | 7/2015 | Krenik | B26B 19/388 83/13 |

* cited by examiner

PROGRAMMABLE HAIR TRIMMING SYSTEM

This application is a continuation of prior U.S. patent application Ser. No. 14/397,869, filed Oct. 30, 2014, which is the U.S. National Phase application under 35 U.S.C. § 371 of International Application No. PCT/DK2013/050105, filed on Apr. 15, 2013, which claims the benefit of Denmark Application No. PA 2012 00292 filed on May 1, 2012, the entire contents of each of which is incorporated herein by reference thereto.

The present invention relates to a hair trimming system, which can be programmed to adjust the hair trimming length according to a position of a hair trimming device in relation to the head of the person, whose hair is being trimmed.

DESCRIPTION OF THE RELATED ART

Hair trimming devices commercially available use either a replaceable or a manually adjustable comb unit in order to control the distance from the trimmer's cutting point to the client's head and thus the hair trimming length.

Using these devices, it is virtually impossible to create neither a smooth fading between different hair lengths, nor a repeatable end result if more than one length setting is applied. They have thus a limited use for other than short and even length haircuts, and, without a distance comb, for trimming off hair at a person's ears and neck area.

It is an object for the present invention to provide a hair trimming system that can be used for a wider range of hairstyles by offering a pre-programmed and repeatable length-fading end result.

BRIEF DESCRIPTION OF THE INVENTION

The present invention relates to a programmable hair trimming system that is arranged to detect, by means of an electromagnetic tracking system, the position of a hair trimming device in relation to a client's head, relate this position to previously generated data regarding the desired trimming length, and to automatically and dynamically adjust the trimming length of said hair trimming device accordingly.

This enables a user to perform a hair trimming with a pre-programmed and repeatable length-fading end result.

In an embodiment of the invention, said hair trimming device further comprises a number of electromagnetic field sources of the electromagnetic tracking system.

This principle allows for 3D positioning with precision and price suitable for a consumer product, with small source and detector sizes suitable for being placed in a hair trimming device and a head tracking device.

In another embodiment of the invention, said hair trimming system comprises a number of electromagnetic field sources of the electromagnetic tracking system, which are external to the hair trimming device, and wherein said hair trimming device further is arranged to detect an electromagnetic field from the electromagnetic field sources of the electromagnetic tracking system by means of one or more sensor units of the electromagnetic tracking system and transmit data regarding said electromagnetic field, which data may be used to determine the position and orientation of the hair trimming device in relation to the electromagnetic field sources of the electromagnetic tracking system.

This layout allows for multiple electromagnetic field sources at various positions, thus allows for additional tracking precision.

In an embodiment of the invention, the hair trimming system further comprises one or more head tracking devices, which are arranged to detect an electromagnetic field from the electromagnetic field sources of the electromagnetic tracking system by means of sensor units of the electromagnetic tracking system, transmit data regarding said electromagnetic field, which data may be used to determine the position and orientation of the head tracking device in relation to the electromagnetic field sources of the electromagnetic tracking system, and receive and playback audio information.

In an embodiment of the invention, one or more of the one or more head tracking devices are arranged to be placed in an ear of a person.

This allows a client on whom a hair trimming is being performed to move his head freely during a hair trimming session, while maintaining the position of said tracking device in relation to his hair in an area that does not interfere with the hair trimming being performed.

In an embodiment of the invention, said hair trimming device comprises an area dedicated for storing, charging and identifying a number of said head tracking devices.

This avoids the need for a separate charger for said head tracking devices, allows for integrated and hygienic storage for and transportation of said head tracking devices, and for automatic pairing of data transmitting hardware, i.e. bluetooth radios, between said devices.

In an embodiment of the invention, said hair trimming device comprises a fixed distance between its user grip area and its distance comb.

This layout allows the person who is holding said hair trimming device to focus on guiding the device on the surface on the client's head, while the hair trimming length adjustment is performed automatically by the motorized length regulation mechanism of the hair trimming device.

In an embodiment of the invention, said hair trimming system further comprises an embedded computer system, arranged to store hair length profile data, communicate with a head tracking device and an external computer system, calculate trimming lengths and adjust the hair trimming length of the hair trimming device.

This allows for performing a hair trimming session using said hair trimming device and said head tracking device, without the use of an external computer system.

In an embodiment of the invention, the data file format used for storing a hair length profile comprises a list of position points on a client's head with accompanying desired trimming lengths.

This allows for a small data file size that can easily be modified and stored, and for using a hair length profile data file on various compatible hair trimming systems.

In an embodiment of the invention, said hair length profile data can be retrieved, modified, visualized and stored on an external computer system.

This allows a user to pre-program a desired hair length profile data file before a hair trimming session is initiated.

In an embodiment of the invention, the progress of an on-going hair trimming session can be monitored on a connected external computer system.

This allows for a user to identify which areas on a client's head that has been covered so far during the hair trimming session.

THE DRAWINGS

Figure 1B:
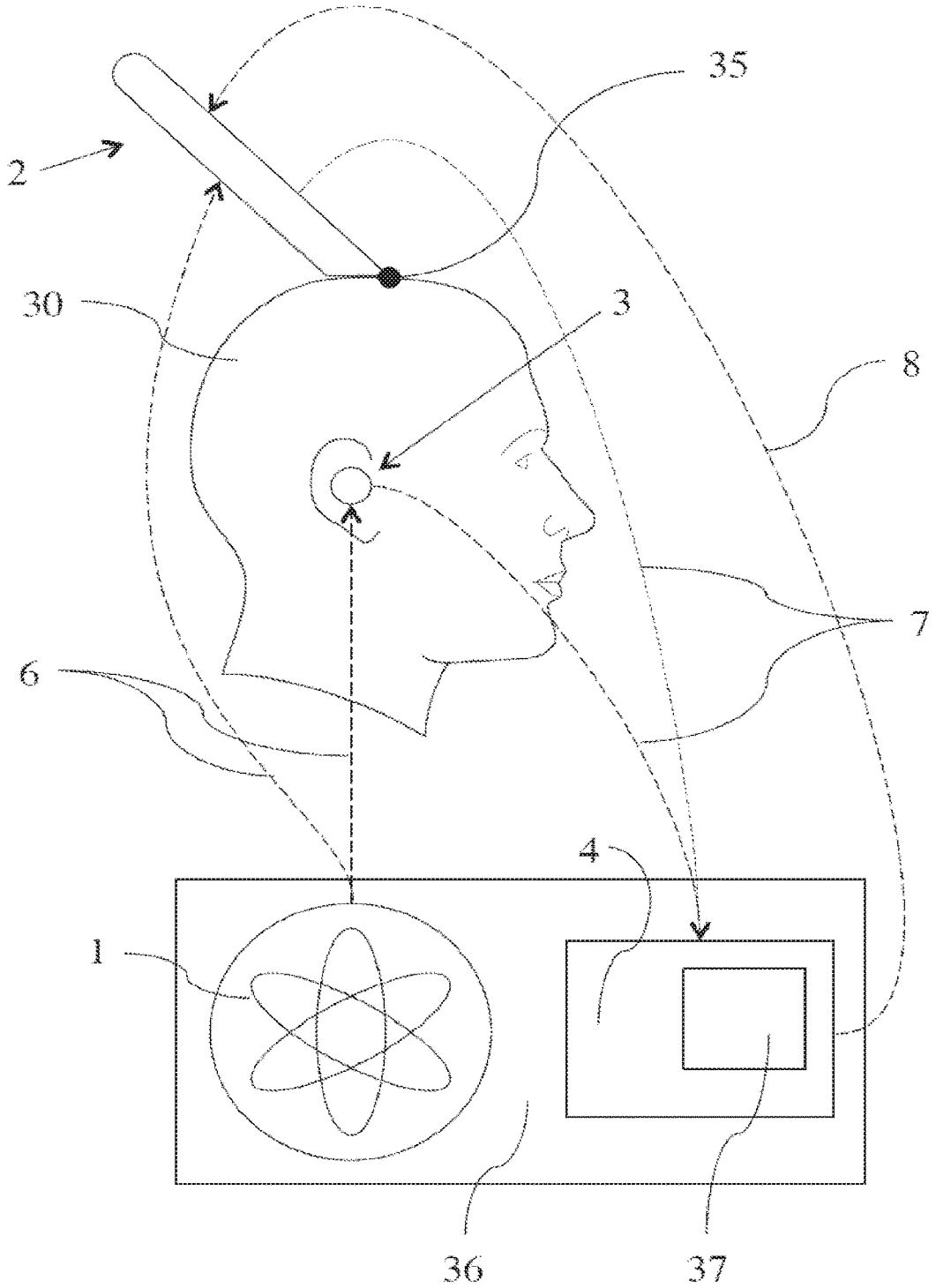
Figure 1C:
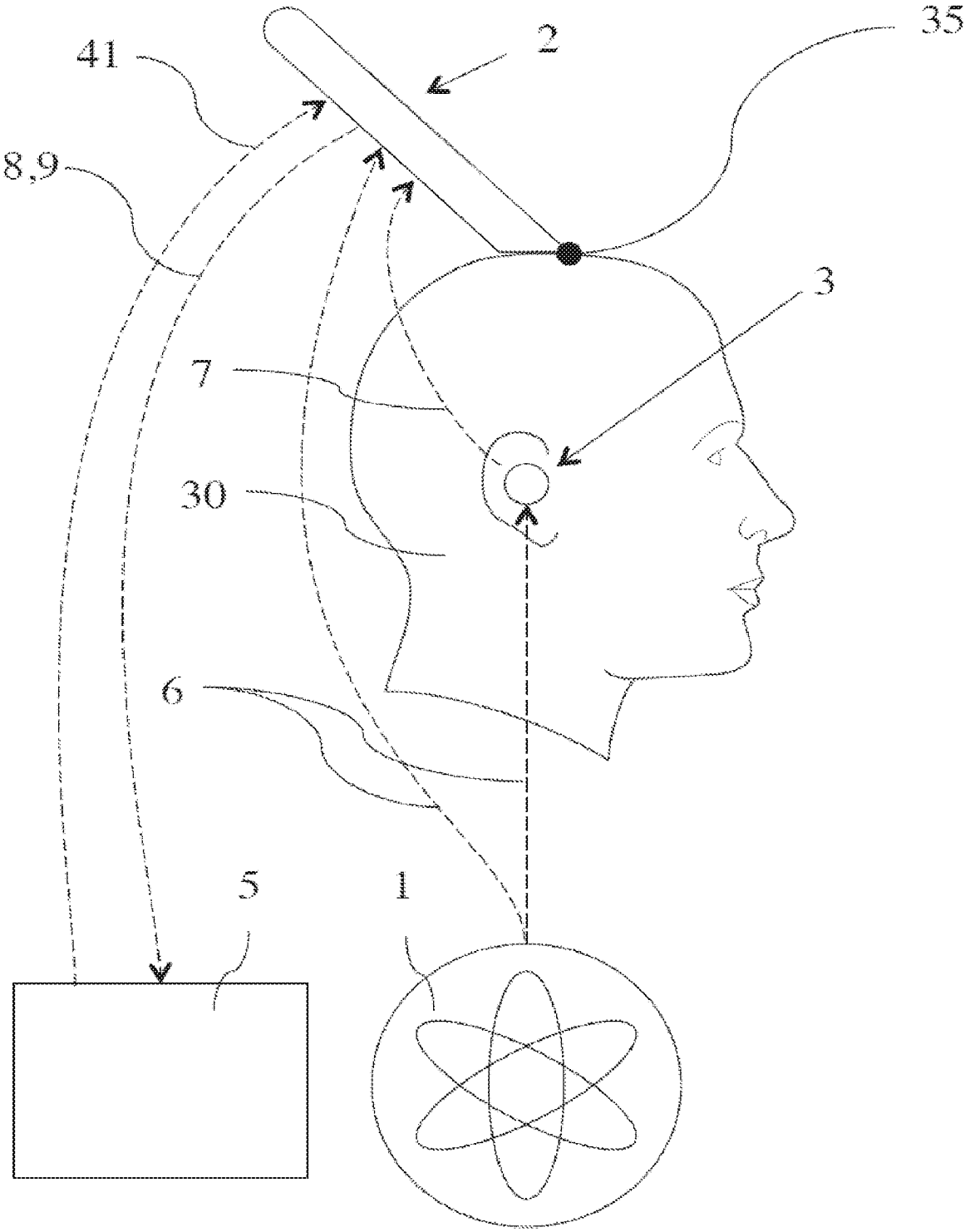
Figure 1D:
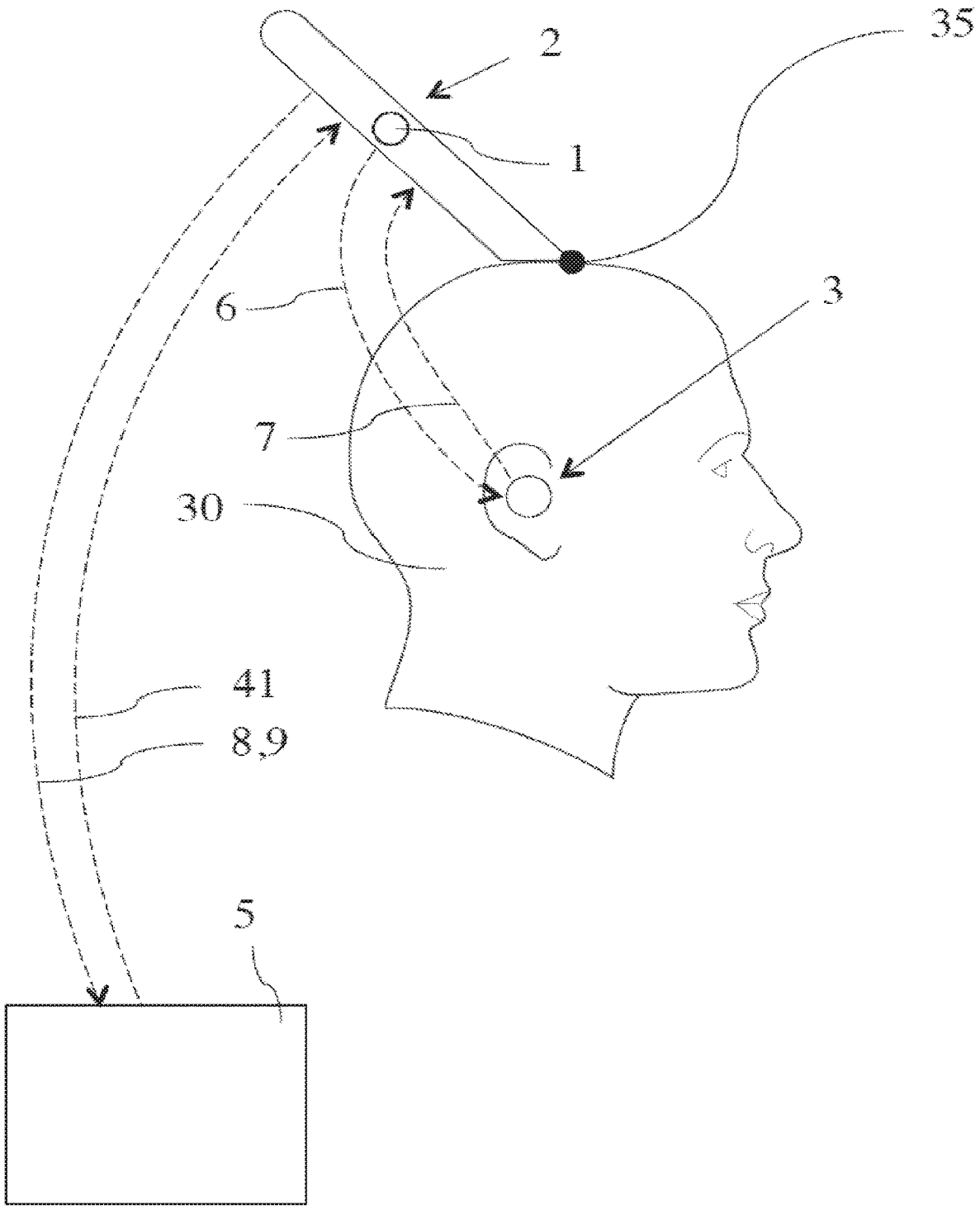
Figure 1E:
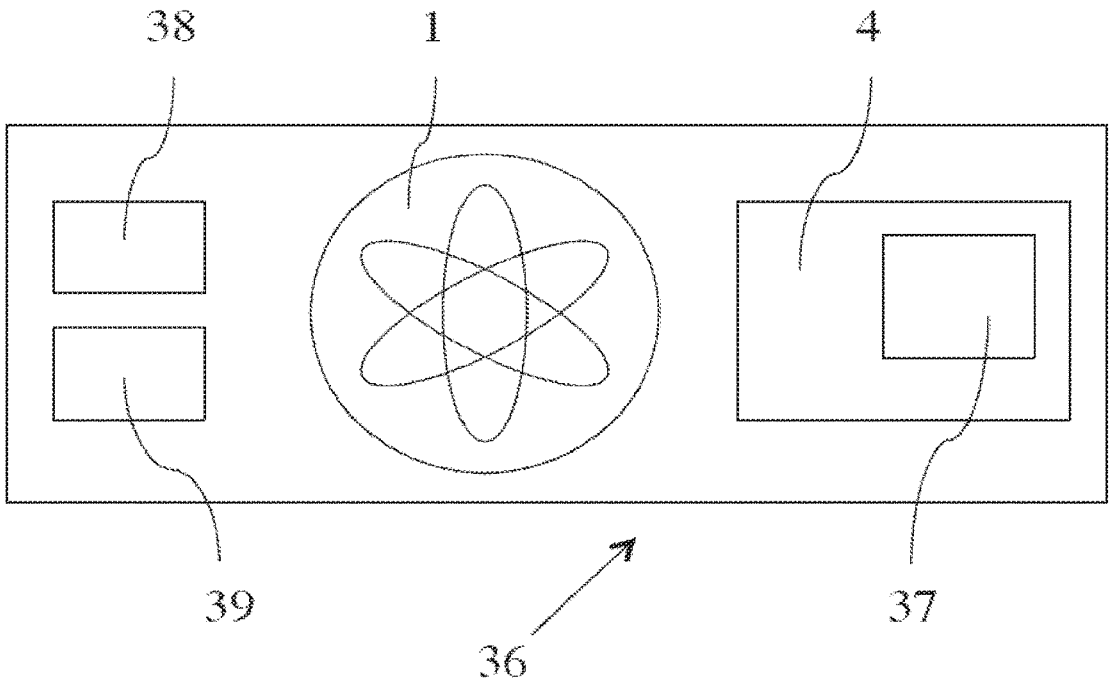
Figure 2:
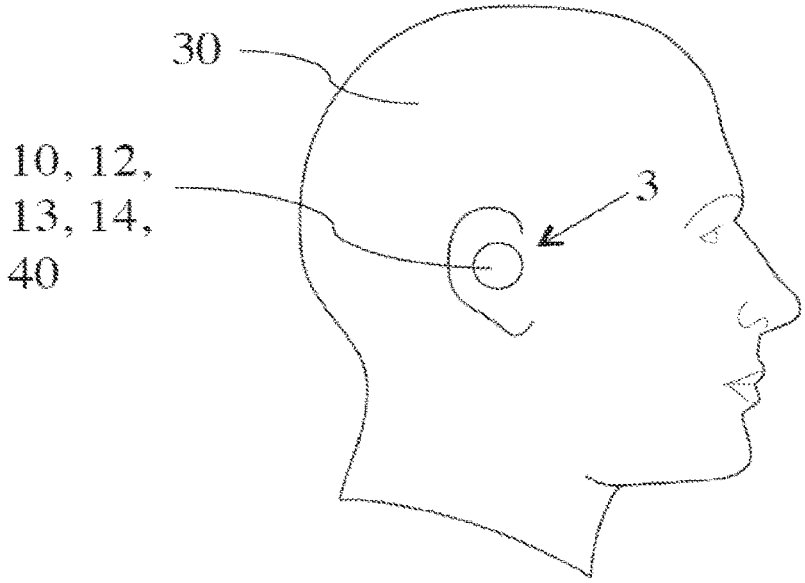
Figure 3A:
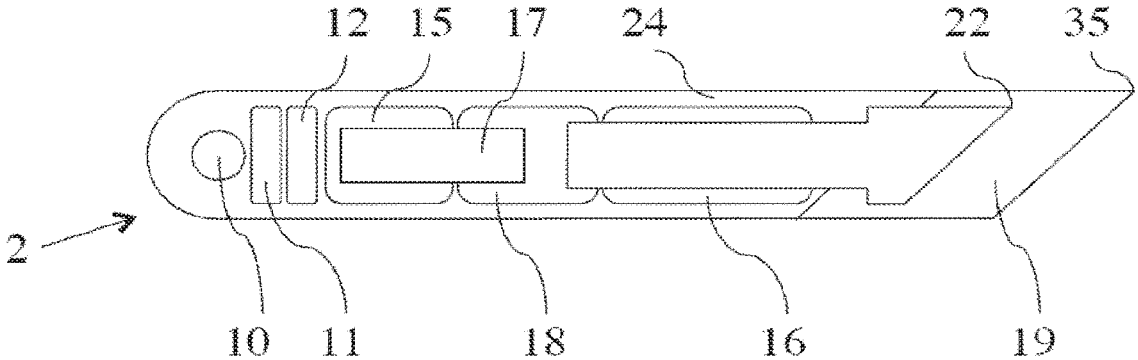
Figure 3B:
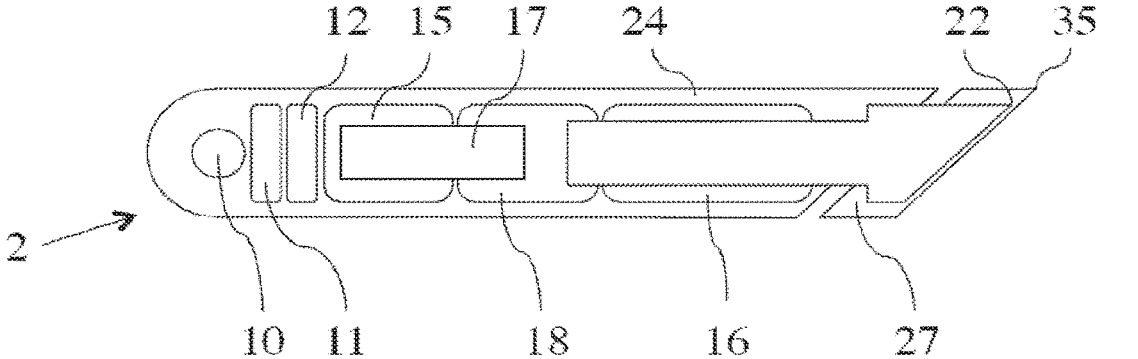
Figure 3C:
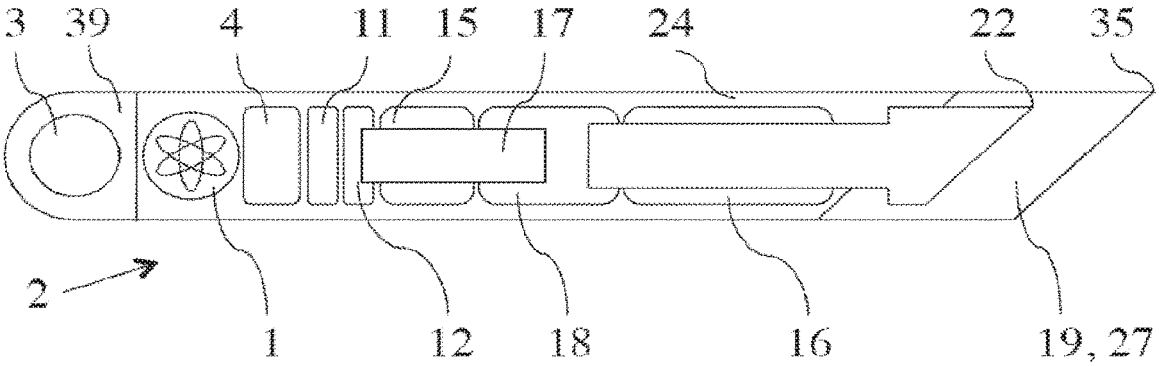
Figure 4A:
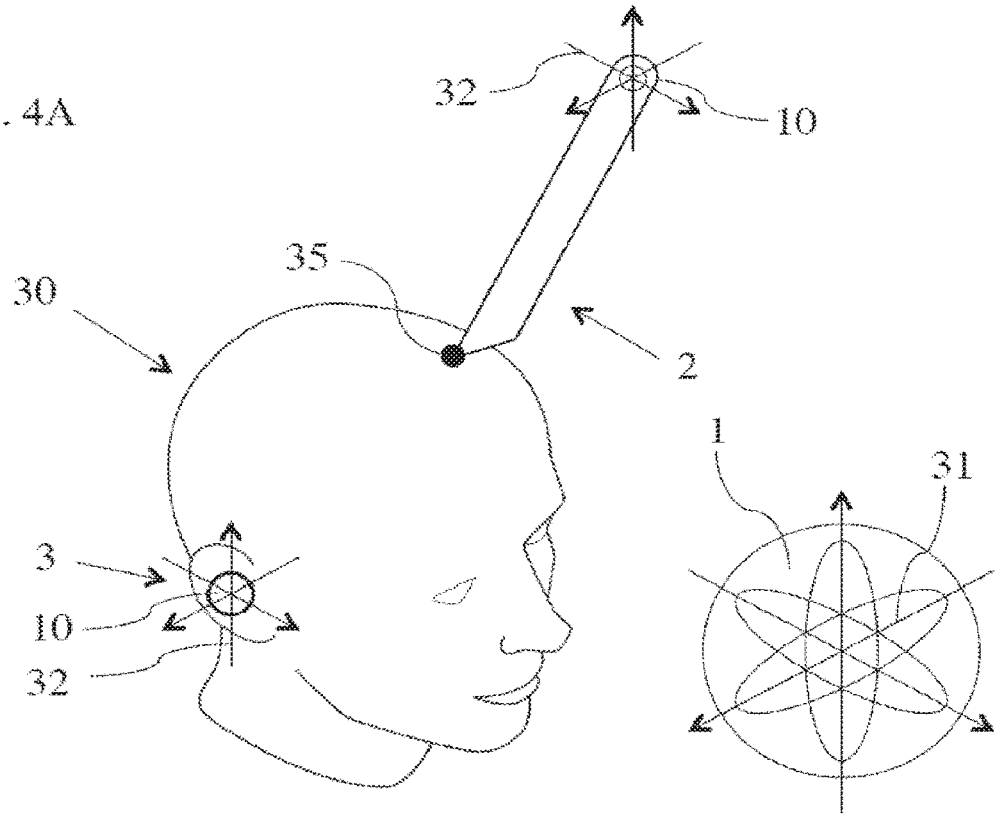
Figure 4B:
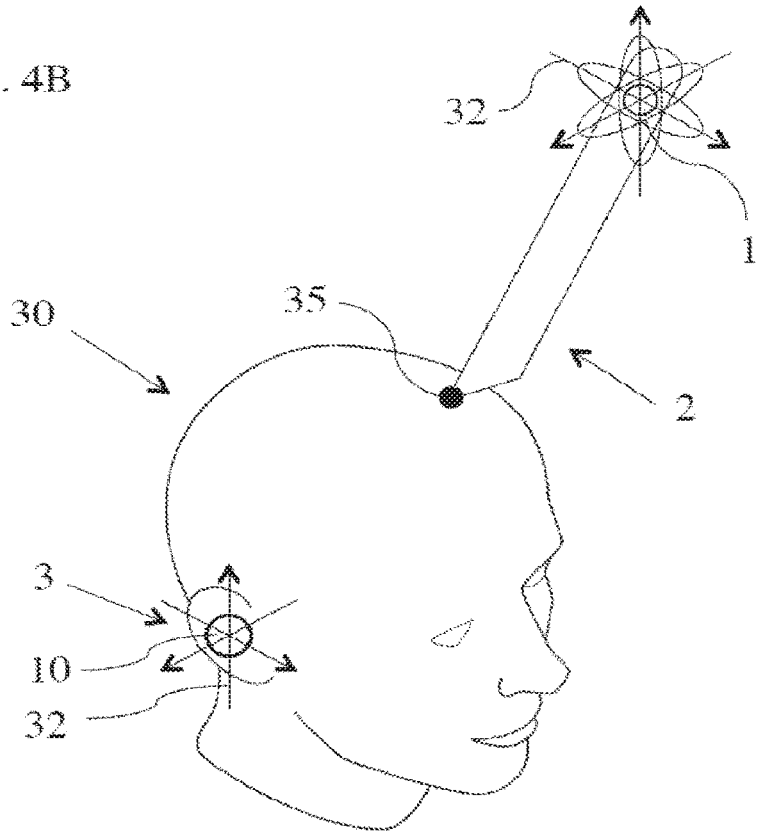
Figure 5A:
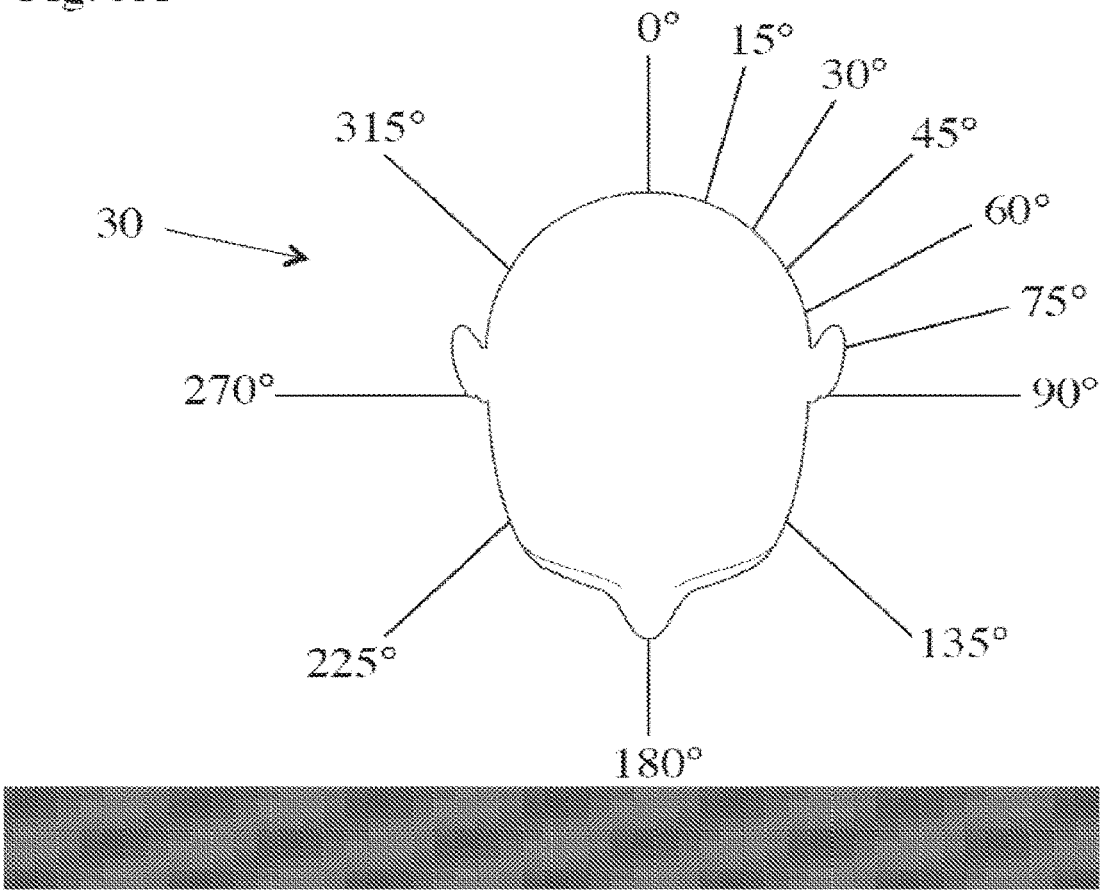
Figure 5B:
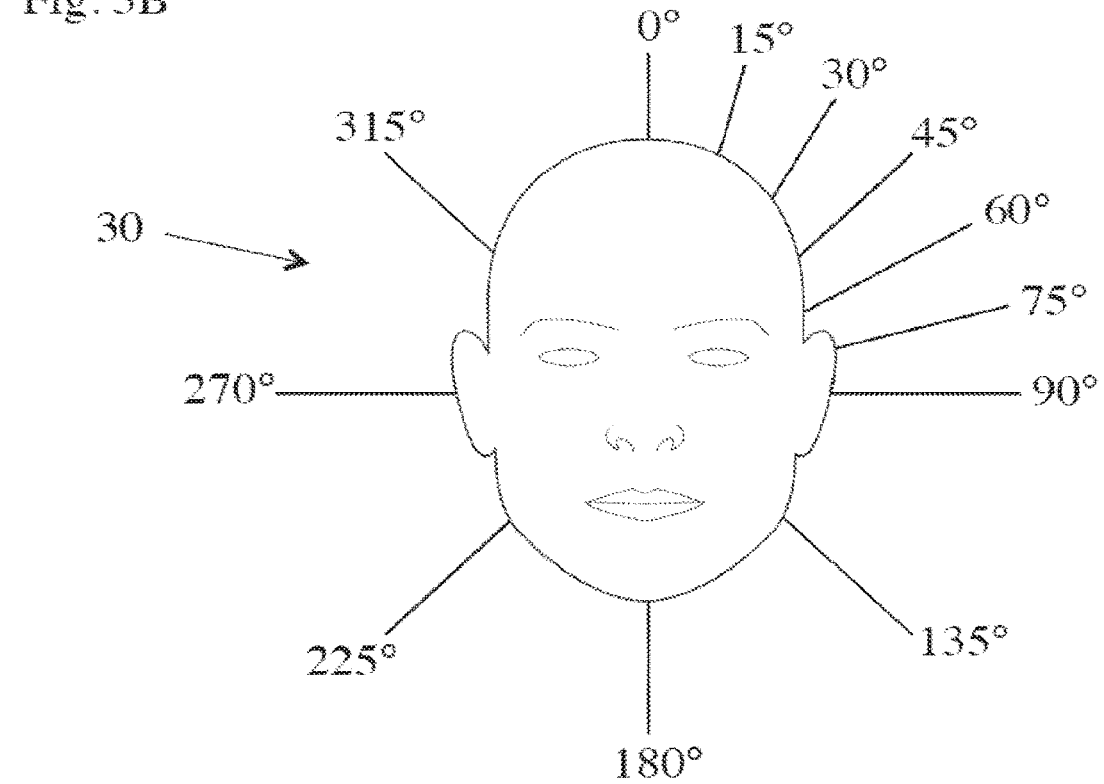
Figure 5C:
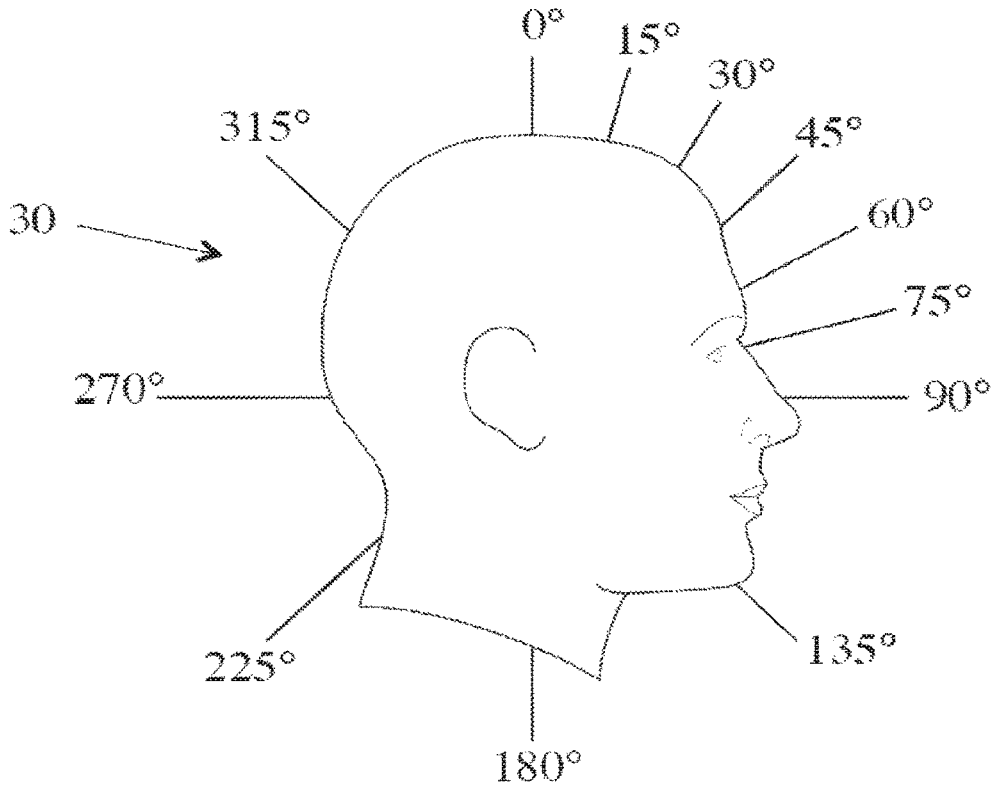
Figure 6A:
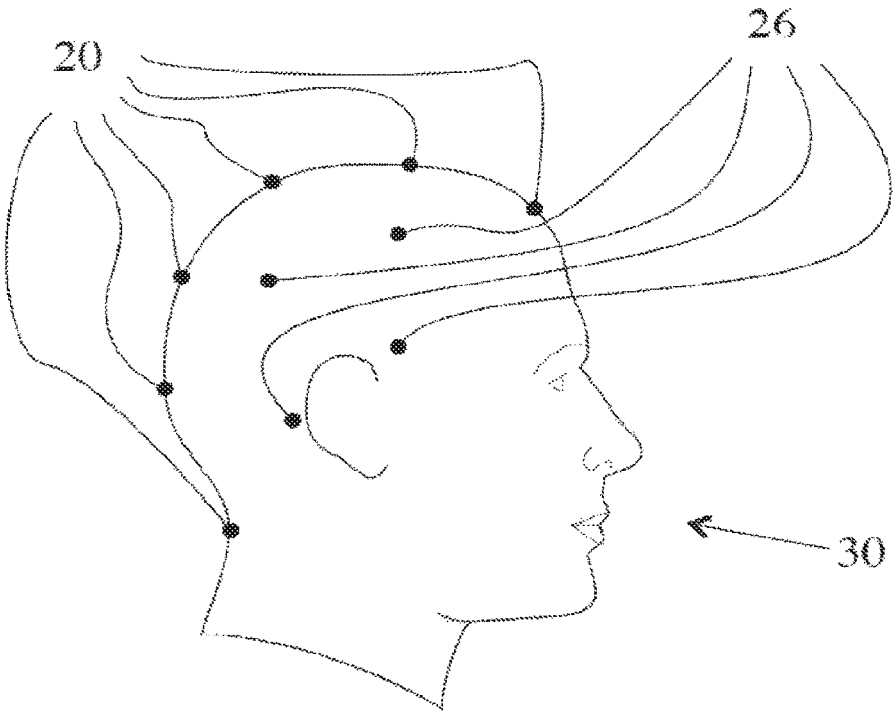
Figure 6B:
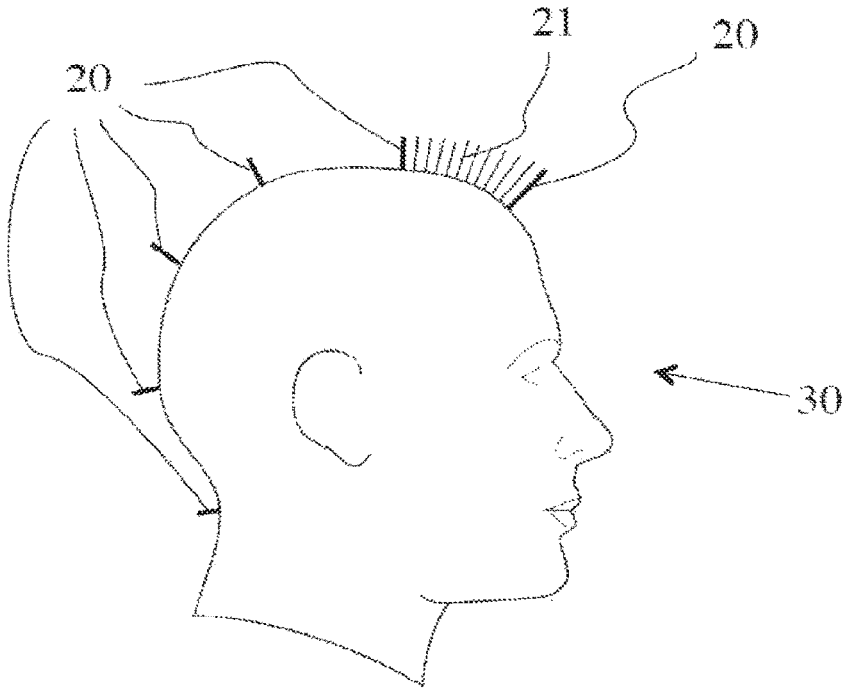
Figure 6C:
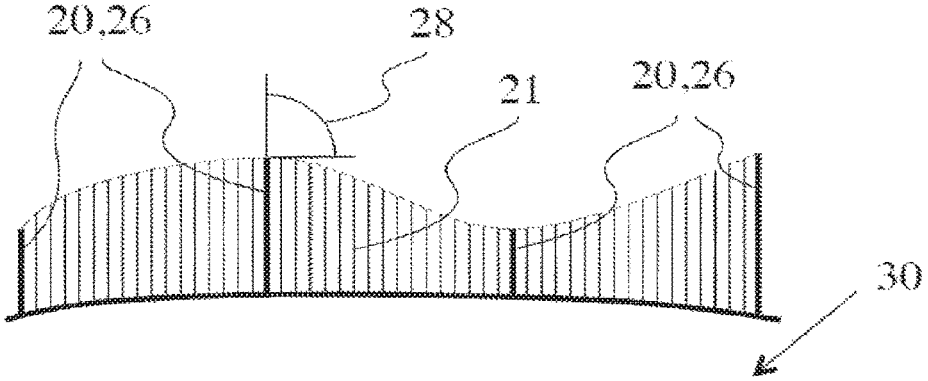
Figure 6D:
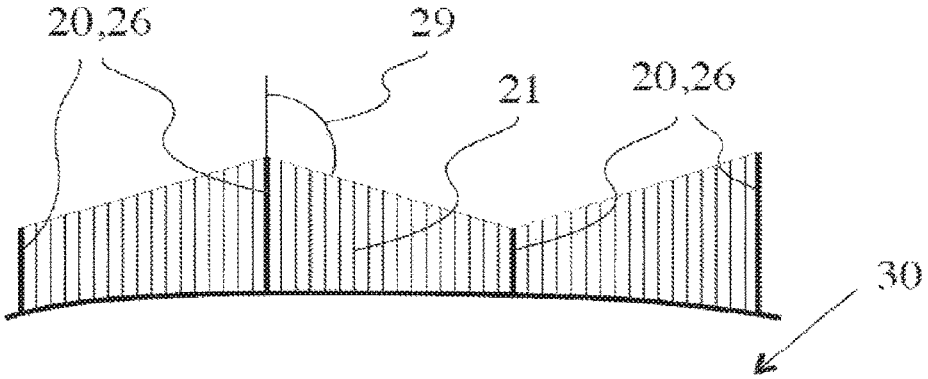
Figure 7:
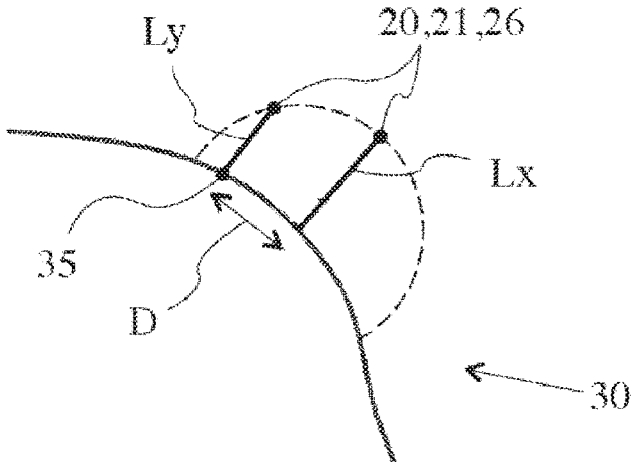
Figure 8A:
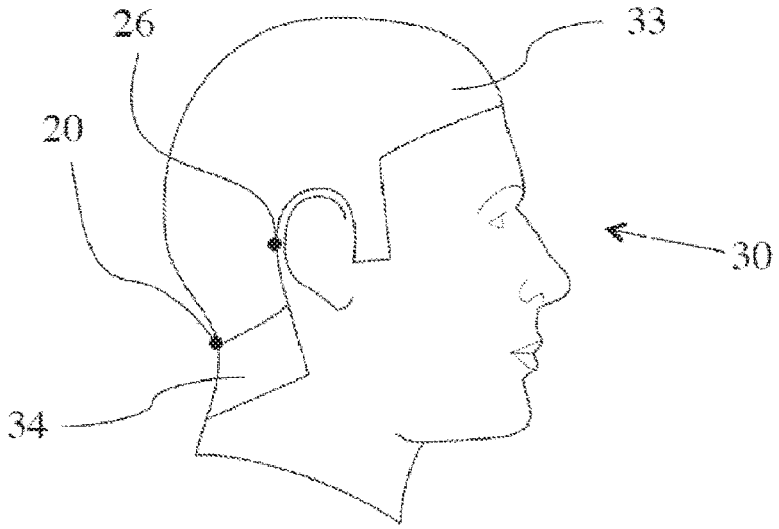
Figure 8B:
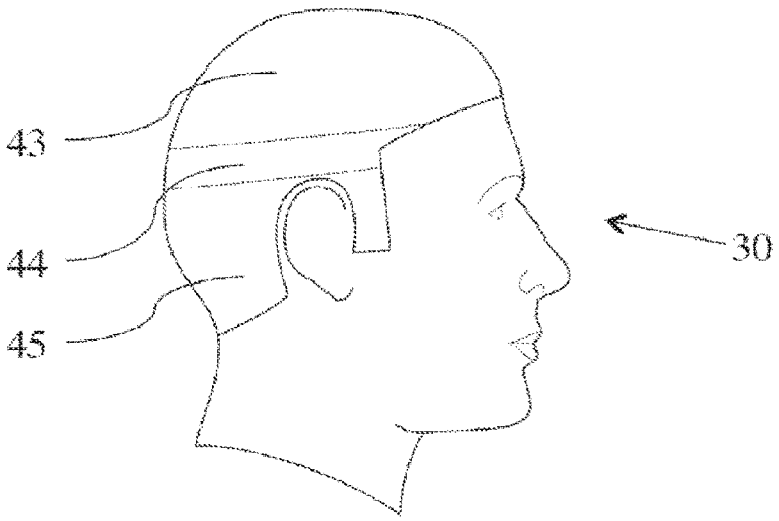
Figure 8C:
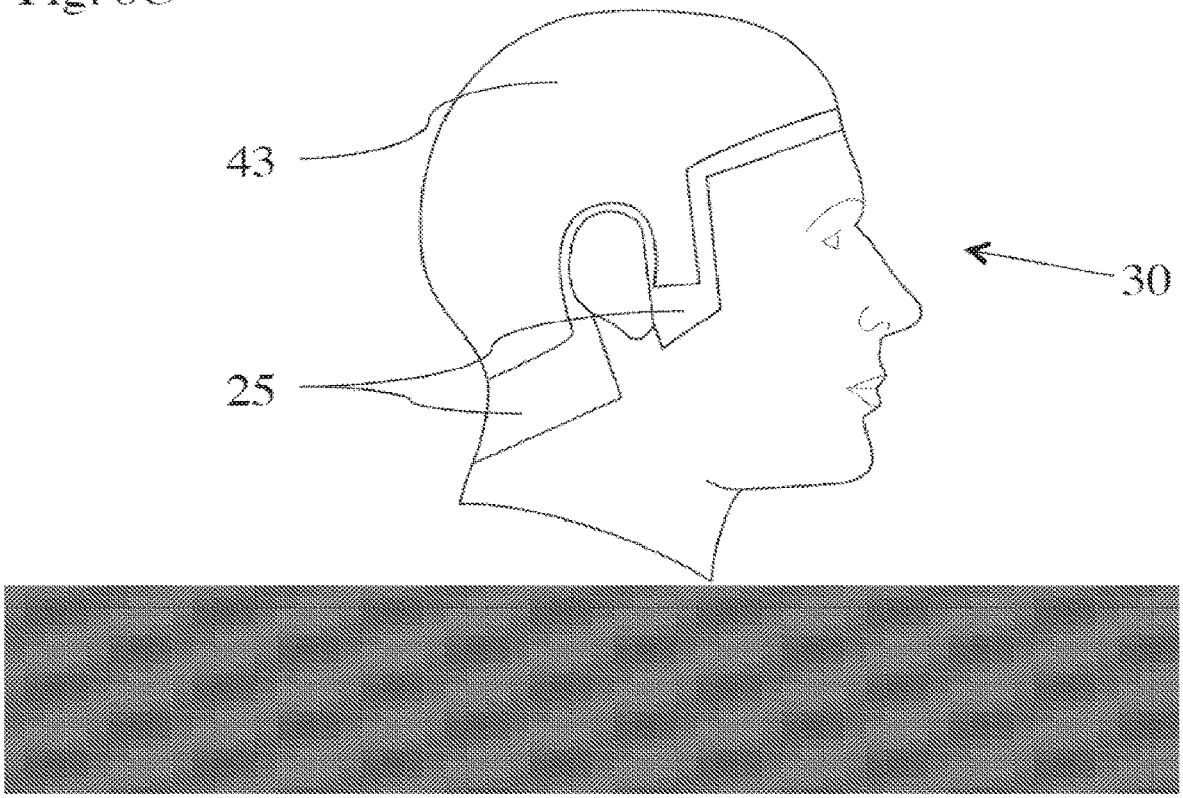
Figure 8D:
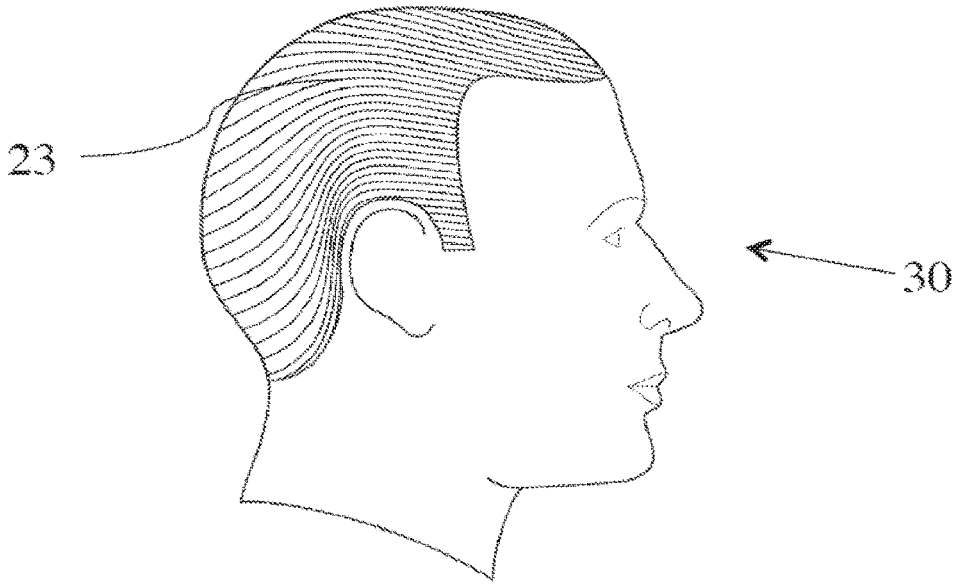
Figure 9:
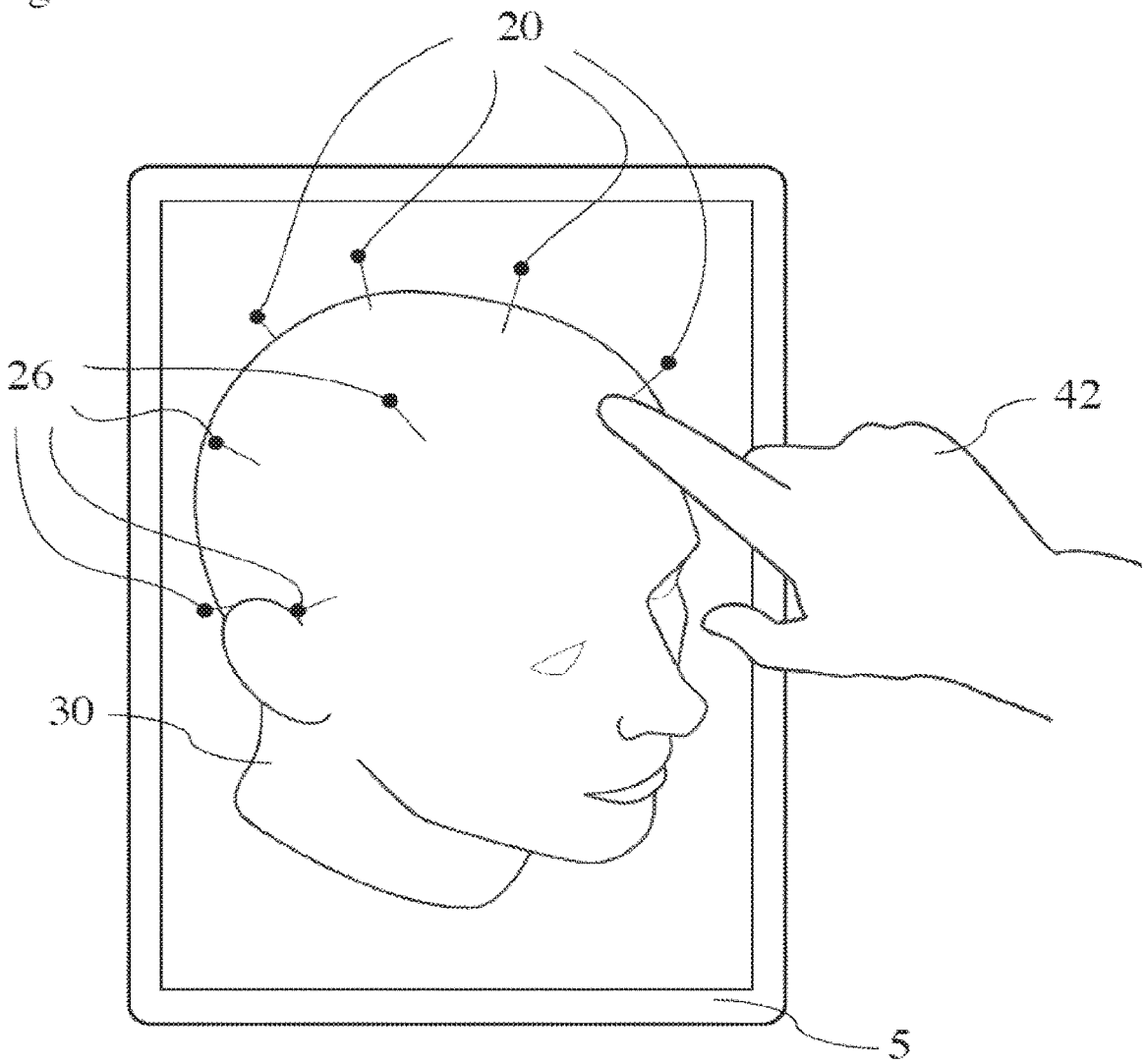

In the following, a few embodiments of the invention are described and explained in more detail with reference to the drawing, where FIG. 1A illustrates schematically an overall system setup with a connected external computer system, and a system unit with an electromagnetic source according to an embodiment of the invention, FIG. 1B illustrates schematically an overall system setup with a system unit with an electromagnetic source and a computer system according to another embodiment of the invention, FIG. 1C illustrates schematically an overall system setup with a connected external computer system, and a hair trimming device with an embedded computer system unit according to another embodiment of the invention, FIG. 1D illustrates schematically an overall system setup with a hair trimming device with an integrated electromagnetic source according to another embodiment of the invention, FIG. 1E illustrates schematically a layout of an integrated system unit with an electromagnetic field source, a computer system, an interactive display and docking/charging areas for a hair trimming device and a head-tracking device according to another embodiment of the invention, FIG. 2 illustrates schematically a head-tracking device layout according to an embodiment of the invention, FIG. 3A illustrates schematically a hair trimming device layout with a fixed distance between a user grip area and a distance comb according to an embodiment of the invention, FIG. 3B illustrates schematically a hair trimming device layout with a fixed distance between a user grip area and a cutting point according to another embodiment of the invention, FIG. 3C illustrates schematically a hair trimming device layout with an integrated electromagnetic field source and a docking/charging area for a head-tracking device according to another embodiment of the invention, FIG. 4A illustrates schematically a relationship between a coordinate system of an external electromagnetic field source, a head-tracking device and a hair trimming device according to an embodiment of the invention, FIG. 4B illustrates schematically a relationship between a coordinate system of an electromagnetic field source inside a hair trimming device, and a head-tracking device according to another embodiment of the invention, FIG. 5A illustrates schematically a longitude vector index of position point data with two perpendicular 360° scales according to an embodiment of the invention, FIG. 5B/C illustrates schematically a latitude vector index of position point data with two perpendicular 360° scales according to an embodiment of the invention, FIG. 6A illustrates schematically a placement of centered and symmetrical position points according to an embodiment of the invention, FIG. 6B illustrates schematically calculated local hair lengths between position point lengths according to an embodiment of the invention, FIG. 6C illustrates schematically calculated smooth Bezier local hair lengths between position point lengths according to an embodiment of the invention, FIG. 6D illustrates schematically calculated linear local hair lengths between position point lengths according to another embodiment of the invention, FIG. 7 illustrates schematically a calculation of the lower length limit for shorter adjacent hair in order to avoid longer hair being trimmed involuntarily at an offset position according to an embodiment of the invention, FIG. 8A illustrates schematically a primary hair area following potential movements of a client's head according to an embodiment of the invention, FIG. 8B illustrates schematically areas with different hair length and their overlapping area when using interchangeable distance combs according to another embodiment of the invention, FIG. 8C illustrates schematically the start-up area where the hair trimming device is placed by the user before guiding the device into the primary hair area according to an embodiment of the invention, FIG. 8D illustrates schematically same-length contour lines according to an embodiment of the invention, and FIG. 9 illustrates schematically the modification of position point lengths on an external computer system according to an embodiment of the invention.

DETAILED DESCRIPTION OF THE INVENTION

In the following descriptions, the term "user" describes the person holding and guiding the hair trimming device during a calibration and/or hair trimming session, and/or is operating an integrated and/or connected external computer system.

The term "client" describes the person on whom a hair trimming is being performed.

These can be multiple persons or a single person.

System Layout:

FIG. 1A/1B/1C/1E illustrates an embodiment of the invention, where the position and orientation of both a client's head (30) and a hair trimming device (2) are monitored in relation to a number of electromagnetic field sources (1) placed next to the client.

The position and orientation of a client's head (30) is monitored using a head-tracking device (3) with an integrated electromagnetic field sensor (10), placed at a point on the client's head that follows his potential movements during a hair trimming session without interfering with the hair trimming procedure.

In an embodiment of the invention, a head-tracking device (3) is in a shape similar to small audio headsets, and is placed inside the client's ear, thus preventing it from moving and turning while in use.

Parts that touch the client's ear channel can optionally be interchangeable for hygienic multiple user scenarios, and for adapting to different ear shapes.

The head-tracking device (3) is powered by a battery (40) that can optionally be recharged while the device is placed in an integrated system unit (36, 39) or a hair trimming device (2, 39).

For increased precision, additional head-tracking devices (3) can be used in the client's other ear and/or on the face area—nose, nasal bridge or in the upper mouth cavity (not shown).

The performance of the electromagnetic tracking system can be adapted to the desired precision by modifying the electromagnetic field source, the sensor units and data calculation/transmission components.

In this embodiment of the invention, the position and rotation of a hair trimming device (2) is simultaneously monitored using an electromagnetic field sensor (10) placed inside the hair trimming device (2).

The hair trimming device (2) can optionally be powered by a battery system (15) that can optionally be recharged while the device is placed in an integrated system unit (36, 38).

The strength, phase and orientation of the detected electromagnetic field (6) is transmitted, wired or wirelessly (7), from a head tracking device (3) and the hair trimming device (2) to an embedded computer system (4).

The embedded computer system (4) can be placed in either an integrated system unit (36), FIG. 1A/1B/1E, or in the hair-trimming device (2), FIG. 1C/1D.

The distance and orientation of the two monitored devices (2, 3) in relation to the electromagnetic field source (1), together with previously generated data regarding the client's head shape (30), provides sufficient data for an embedded computer system (4) to calculate the position of the hair trimming device's (2) position reference point (35) in relation to the client's head (30).

This position information is compared by the embedded computer system (4) to previously generated data about the desired local hair length (21) at any given point on the client's head (30).

The derived hair trimming length (21) is transmitted, wired or wirelessly (8), to the hair trimming device's (2) length regulation control system (11) and length regulation mechanism (18), which dynamically and automatically adjusts the hair trimming length accordingly.

In another embodiment of the invention, FIG. 1D, the position and orientation of a client's head (30) is monitored in relation to an electromagnetic field source (1) placed inside the hair trimming device (2).

The strength, phase and orientation of the detected electromagnetic field (6) is transmitted, wired or wirelessly (7), from the head tracking device (3) to an embedded computer system (4), placed in either an integrated system unit (36) or in the hair trimming device (2).

The distance and orientation of the head tracking device (3) in relation to the hair trimming device's electromagnetic field source (1), together with previously generated data regarding the client's head shape (30), provides sufficient data for the embedded computer system (4) to calculate the position of the hair trimming device's (2) position reference point (35) in relation to the client's head (30).

The invention is characterized by utilizing a general data file format and separate hair trimming hardware. This allows for the same data file to be used by hardware with various features, i.e. cutting point design, optional vacuum, grid resolution, wired/wireless and trimming length adjusting mechanism design.

Head Shape Calibration Procedure:

The hair trimming system can be adapted more precisely to the client's head (30) via an initial calibration procedure that generates a 3D representation of the client's head shape (30).

This once-per-client procedure can be performed using either a dedicated calibration device (not shown), alternatively by setting a hair trimming device (2) in a calibration mode with its trimmer motor (16) turned off.

The head shape calibration procedure can be performed using either an external computer system (5) or a computer system in an integrated system unit (36), hereafter called "the calibration system".

As the distance between the electromagnetic field unit (1, 10) and the hair trimmer position reference point (35) is programmed into calibration system, these two components can be separately placed, FIG. 4A/B.

At the beginning of the head shape calibration procedure, the system's head-tracking device (3) is switched on and mounted on the client.

The hair trimming device (2) in calibration mode is placed by the user (42) at a number of random points on the client's head (30, 33). The user (42) can optionally confirm the placement by pressing a button (not shown) on the handheld device.

The calibration system software provides the user (42) with a visual and/or acoustic feedback signal when a calibration point has been registered, and can also optionally show the areas that the user (42) has covered so far and the areas where he still needs to position the hair trimming device (2) in calibration mode.

The calibration system indicates when the number of calibration points is sufficient for it to generate a smooth 3D representation of the shape of the client's head (30).

A similar calibration procedure can optionally be performed registering the client's (30) hairlines for greater precision in the following hair length profile creation and modification procedure.

The head shape and optional hairline calibration procedure can be repeated for multiple clients (30), and the result can be stored as individual head shape/hairline data files in an external computer system (5), and/or in the embedded computer system (4), and/or in a database accessible via connected computers i.e. the internet, and/or on local media i.e. USB memory devices, and/or portable devices such as mobile telephones.

Hair Length Profile (HLP) (41) Creation and Modification Procedure:

The HLP (41) creation and modification procedure can be performed using an external computer system (5) and/or an embedded computer system (4) in an integrated system unit (36), hereafter called the "HLP modification system".

A HLP (41) contains a set of position points (20, 26), each with an accompanying hair length between zero mm and a maximum length determined by a hair trimming device's adjustment travel length.

The number of position points (20, 26) for a HLP (41) should be small enough to allow for a smooth HLP (41), while maintaining the resolution needed for hair length variation, preferably four to eight centered position points (20) and two to six pairs of symmetrical position points (26).

The number of calculated steps between the positions (20, 26) can be adjusted by the HLP modification system with due respect for seamless steps, preferably not larger than one mm.

As a HLP (41) consists of said position points (20, 26) and accompanying position point lengths (20), the software of the embedded computer system will be calculating the local hair lengths (21), optimized for the precision of the length regulation mechanism (18) of its hair trimming device (2).

Each position point (20, 26) consists of an X value, FIG. 5A, and a Y value, FIG. 5B/C, similar to the geographic coordinate system of a globe. A position point (20, 26) can thus be considered as a 3D vector direction with origin at a virtual center inside a client's head (30).

The centered position points (20) all share an X value of zero, while the symmetrical position points (26) all have a mirrored twin point with similar Y value and an X value of three-hundred-and-sixty degrees minus the opposite point's X value. The symmetric position points (26) can optionally be replaced by individual position points (not shown) without a mirrored twin point on the opposite side of the client's head (30).

In an embodiment of the invention, the HLP modification system can present a number of default HLPs 41 for the user (42) to choose from.

In another embodiment of the invention, the user (42) enters length values at a number of points on the client's head (30) into the HLP modification system. These values can be based on manually measured hair lengths on the client's head whilst having a desired hair length.

During this manual procedure, the HLP modification system can show to the user (42) where values needs to be added in order to generate a HLP (41).

The HLP modification system can adapt the current HLP (41) to the previously performed registration of the client's head shape and optional hairline registration, and visualize the generated HLP (41) to the user (42).

The HLP modification system software allows the user (42) to modify the HLP (41) by selecting a position (20, 26) and then adjust its accompanying hair length, FIG. 9.

The length selectable at any position point (20, 26) is limited by the maximum travel distance of the length regulation mechanism (18) of the hair trimming device (2) to be used.

The limit for local length variation is given by the equation $$LY \geq sqr(Lx^2 - D^2)$$

where Ly is the minimum length of a hair at the distance D from a longer hair with the length Lx, FIG. 7.

If the trimming length setting at Ly is shorter that given by said equation, longer Lx hair could be trimmed involuntarily at the Ly position.

The HLP modification system prevents the user (42) from adjusting a position point hair length (20, 26) with too much local variation according to said equation.

The length setting for the neck hair area (34) is automatically set to a similar level as at the closest position point/length (20, 26), as this area not necessarily follows the head-tracking device when the client (30) moves/twists/bends his head.

The fade shape between position lengths (20, 26) is by default set to a smooth Bezier curve (28), FIG. 6C, and can be modified by the user (42) towards a sharper connection angle (29), FIG. 6D.

When the user (42) has changed the hair length at any position point (20, 26), the HLP modification system updates the HLP (41) by generating the calculated local hair lengths (21) between the position lengths (20, 26).

The user (42) can choose to modify any number of position points (20, 26).

The updated HLP (41) can be displayed by the HLP modification system by visualizing the position lengths (20, 26) and the calculated local hair lengths (21) in a "hedgehog" style, and/or a terrain style with lines illustrating contours (23) with similar hair length.

The updated HLP (41) can be illustrated by the HLP modification system by showing a number of hairstyles possible with the currently selected HLP (41).

The updated HLP (41) and potential hairstyles an be displayed by the HLP modification system in combination with a number of photographs of the client's face, front and profile, visualized on a 3D head for a more realistic preview of the potential end result.

The updated HLP (41) can be stored in an external computer system (5), and/or in a database accessible via connected computers i.e. the internet, and/or on local media i.e. USB memory devices, and/or portable devices such as mobile telephones.

A number of HLPs (41) can be stored in the embedded computer system (4) placed in either the hair trimming device (2) or the integrated system unit (36).

Hair Trimming Start-Up Procedure:

Prior to a trimming session, the user (42) selects which HLP (41) to use.

In an embodiment of the invention, the HLP (41) can be selected on an interactive display (17) on the hair trimming device (2) and/or on an interactive display (37) of an integrated system unit (36).

In another embodiment of the invention, the HLP (41) can be selected on an external computer system (5) connected to the trimming system.

In order to verify the placement and orientation of a head-tracking device (3), and to verify that the HLP (41) selected is compatible with the current client (30), a start-up calibration procedure is performed by the user (42).

At the beginning of the start-up calibration procedure, the system's head-tracking device (3) is switched on and mounted on the client (30).

The hair trimming device (2) with its trimmer motor (16) switched off is placed by the user (42) at a number of points on the client's head (30). The user (42) can optionally confirm the placement by pressing a button (not shown) on the hair trimming device (2).

The embedded computer system (4) gives the user (42) visual and/or acoustic feedback when a calibration point has been detected, after which the user (42) places the hair trimming device (2) at another random point on the client's head (30).

The user (42) can optionally follow the calibration procedure on a connected external computer system (5) or the interactive display (37) of the integrated system unit (36), which shows the areas where the user (42) so far has and still needs to position the hair trimming device (2) in calibration mode.

When sufficient points have been detected by the embedded computer system (4) to verify the compatibility between the client (30) and the HLP (41) as well as the placement and orientation of the head-tracking device (3) in relation to the client's head (30), the user (42) is informed visually and/or acoustically by the embedded computer system (4), and the hair trimming can begin.

The trimmer motor (16) can optionally be prevented from being switched on until a start-up calibration is completed, or unless the hair trimming device (2) is set in a manual length regulation mode.

Hair Trimming Procedure:

The user (42) places the hair trimming device (2) in a start-up area (25) on the client's head (30), with contact detected by a pressure sensitive sensor in the hair trimming device (not shown). The hair trimming device (2) detects and confirms the placement in the start-up area (25) as well as the trimmer/head contact via said pressure sensitive sensor, and starts the trimming motor (16) automatically.

During a hair trimming session, the user (42) guides the hair trimming device (2) on the surface of the client's head (30) in the same way, as he would use a commercially available hair trimming device.

The hair trimming procedure can be visualized using an external computer system (5) and/or an embedded computer system (4), hereafter called "the hair trimming visualization system".

The hair trimming visualization system can display the current position of the hair trimmer position reference point (35) on the client's head (30), including a visualization of the area on the client's head (30) covered so far during the current session.

The hair trimming visualization system can show the user (42) to move the hair trimming device (2) perpendicular to contour lines (23) with the same trimming height, typically from a start-up area (25) towards the top of the client's head, in order to prevent that a hair trimming device (2) with a wide cutting point (22) trims off too much hair.

Information about i.e. the current hair trimming length, data signal strength and battery levels can be displayed on the interactive displays (17) and/or (37).

If the system includes a head-tracking device (3) with built-in audio receiver (13) and loudspeaker (14), audio information regarding the current trimming length can optionally be provided to the client (30), which would be desirable if he is guiding the hair trimming device (2) himself, and/or if no hair trimming visualizing system is used during the trimming session.

If, for whatever reason, the data stream (7) from an electromagnetic field sensor (10) to the embedded computer system (4) is interrupted, and/or the user (42) moves the hair trimming device (2) too fast for the embedded computer system (4) to calculate and transmit (8) the current length to the hair trimming device's (2) embedded length regulation control system (11), and/or the transmission of trimming length data (8) from the embedded computer system (4) to the hair trimming device (2) is interrupted, and/or the hair trimming device (2) is lifted from the client's head (30), then the trimmer motor (16) is automatically shut off, and/or the length regulation mechanism (18) is set to its maximum trimming length.

In an embodiment of the invention, FIG. 3A, the hair trimming device (2) has a fixed distance between its user grip area (24) and its comb (19), while the cutting point (22) of the hair trimming device (2) is moved up and down inside the distance comb (19) by the length regulation mechanism (18).

This allows the user (42) to focus on guiding the hair trimming device (2) on the surface of the client's head (30) without paying attention the automatically adjusted trimming length.

In order to minimize the size and weight of the moving parts, a heavy trimmer motor (16) should be at a fixed position inside the hair trimming device (2), and the length regulation mechanism (18) should only move a minimum of mass, including the cutting point (22).

In another embodiment of the invention, FIG. 3B, a moveable distance comb unit (27) is used, whilst the cutting point (22) is fixed in the hair trimming device (2).

This is similar to the layout of most of today's commercially available hair trimming, but also requires that the user (42) constantly applies both sufficient pressure on the client's head (30) in order to keep the distance comb unit (27) touching the surface of client's head (30), and at the same time not using too much force that could prevent the moveable distance comb (27) from increasing the trimming distance.

Unless the electromagnetic field sensor (10) or electromagnetic field source (1) in the hair trimming device (2) is placed in a fixed relation to a moveable distance comb (27), the embedded computer system (4) compensates for the movement of the hair trimmer position reference point (35) when the latter embodiment is implemented.

In an embodiment of the invention, the layout of the cutting point (22) mechanism is similar to hair trimming devices commercially available, with a horizontally moving shearing blade moving in parallel to a static blade.

In another embodiment of the invention, the layout of the cutting point (22) contains a rotating cutting system, similar to other hair trimming devices commercially available, mostly with an integrated vacuum system.

In another embodiment of the invention, the hair trimming device (2) is connected to a vacuum unit (not shown) as applied by a number of commercially available hair trimming devices, which assists the distance comb (19, 27) in lifting the hair perpendicular to the client's head (30). This reduces the need for trimming the current area multiple times, as more hair is likely to be trimmed the first time the hair trimming device (2) is passing an area.

A connected vacuum unit could also remove trimmed-off hair and thus reduce the need for cleaning of both the hair trimming device (2) and the client (30) afterwards.

The vacuum can be generated by an external system collecting the hair clippings, or a vacuum generator integrated in the hair trimming device (2) itself, including a reservoir for collecting hair clippings.

In another embodiment of the invention, a hair-thinning attachment (not shown) can be engaged at the cutting point (22), as applied by a number of commercially available hair trimming devices.

This hair-thinning attachment reduces the amount of hair that is caught at the cutting point (22), and thus provides an end result with a more fluffy and random appearance, which can be desirable for some clients (30).

As the optional hair trimming visualization system can display the area covered during the current trimming session, the user (42) can monitor which areas has been trimmed and/or thinned out so far during the current hair trimming/thinning session. This is especially useful when the user (42) and client (30) is the same person.

In another embodiment of the invention, the distance comb (19) is interchangeable, thus making it possible for using the hair trimming system for hairstyles with longer lengths than the travel length of the length regulation mechanism (18).

I.e. if the length regulation mechanism (18) has a travel distance of thirty mm, one distance comb (19) could cover zero-to-thirty mm hair lengths, and another could be used on twenty-to fifty mm lengths.

If these replaceable fixed-length distance combs (19) are to be used during the same hair trimming session, a connected hair trimming visualization system (5) can show the user which areas to trim with the current distance comb (19), FIG. 8B. The hair trimming unit (2) will automatically shut off its trimmer motor (16), if the user involuntarily moves a short length distance comb from its intended area (45) via an overlapping hair length area (44) and into an area with longer hair (43).

In another embodiment of the invention, the user (42) can temporarily modify the selected HLP (41) by adjusting all position point (20, 26) lengths with a chosen percentage, i.e. plus/minus ten percent, and/or a chosen distance, i.e. plus/minus two millimeter. The user (42) can also temporarily modify the selected HLP (41) by adding one or more ad-hoc position points and/or by modifying one or more position points (20, 26).

These temporary HLP (41) modifications can optionally be performed using the interactive display (17) on the hair trimming device (2).

In another embodiment of the invention, the user (42) can manually adjust the length regulation mechanism (18), and thus use the hair trimming device (2) as the manually adjustable hair trimming devices commercially available, without the need for additional hardware.

It should be noted that the described embodiments are exemplary only and are not in any way meant to limit the scope of protection, which is defined by the claims listed here below.

LIST OF REFERENCE NUMBERS

1. Electromagnetic field source
2. Hair trimming device

3. Head-tracking device
4. Embedded computer system
5. External computer system
6. Electromagnetic field
7. Electromagnetic field data
8. Trimming length data
9. Position data
10. Electromagnetic field sensor
11. Length regulation control system
12. Electromagnetic field data transmitter
13. Audio receiver
14. Loudspeaker
15. Battery
16. Trimmer motor
17. Interactive display
18. Length regulation mechanism
19. Fixed distance comb
20. Centered position point/length
21. Calculated local hair length/trimming length
22. Cutting point
23. Contour lines
24. User grip area
25. Start-up area
26. Symmetric position point/length
27. Moveable distance comb
28. Smooth Bezier local hair length connection angle
29. Sharp local hair length connection angle
30. Client/Client head/Client head shape
31. Static 3D coordinate system
32. Relative 3D coordinate system
33. Primary hair area
34. Neck hair area
35. Hair trimmer position reference point
36. Integrated system unit
37. Interactive display
38. Hair trimming device docking/charging compartment
39. Head-tracking device docking/charging compartment
40. Battery
41. Hair length profile data
42. User of external computer system/hair trimmer device
43. Longer hair area
44. Overlapping hair length area
45. Shorter hair area

What is claimed is:

1. A hair trimming device comprising:

a hair cutting mechanism comprising a movable blade and a static blade, wherein the movable blade is movable with reference to the static blade to cut hair there between;

a tracking system comprising a transmitting device and a sensing device, wherein the sensing device is configured to detect a position of the transmitting device and thereby detect a position of the hair trimming device in relation to a head of a person on whom a hair trimming is being performed;

a length adjusting mechanism coupled to the hair cutting mechanism, the length adjusting mechanism including a motor configured to move the hair cutting mechanism relative to the head of the person on whom the hair trimming is being performed to set a hair trimming length of the hair cutting mechanism; and a processor coupled to the tracking system and the length adjusting mechanism, wherein the processor is configured to calculate the hair trimming length set by the length adjusting mechanism automatically for all hair lengths that correspond to hair trimming positions on the head other than various individual position points based on previously generated hair length profile data that identifies a corresponding hair length only at the various individual position points on the head, and while the hair trimming device is guided by a user on the head of the person, the processor is further configured to dynamically adjust the hair trimming length set by the length adjusting mechanism automatically according to a detected present position of the hair trimming device, wherein the dynamic adjustment comprises dynamically adjusting the hair trimming length set by the length adjusting mechanism to the corresponding calculated hair trimming length automatically for all hair lengths that correspond to hair trimming positions on the head other than the various individual position points and dynamically adjusting the hair trimming length set by the length adjusting mechanism automatically to the corresponding hair length when the detected present position is at the various individual position points.

2. The hair trimming device of claim 1, wherein the processor is further configured to calculate the hair trimming length set by the length adjusting mechanism for a neck hair area to a same length as a closest position point length.

3. The hair trimming device of claim 1, wherein the tracking system comprises:

at least one electromagnetic field source which is external to the hair trimming device; and one or more sensors configured to:

detect an electromagnetic field from the at least one electromagnetic field source; and transmit data regarding the electromagnetic field, wherein the tracking system is configured to use the data to detect the position and orientation of the hair trimming device in relation to the electromagnetic field source.

4. The hair trimming device of claim 1, wherein the tracking system further comprises:

an electromagnetic field source; and one or more head tracking devices, which are arranged to detect an electromagnetic field from the electromagnetic field source, transmit the detected data regarding the electromagnetic field, wherein the tracking system is configured to use the data to determine a position and orientation of the head tracking device in relation to the electromagnetic field source, and receive and playback audio information based on the determined position and orientation of the head tracking device.

5. The hair trimming device of claim 4, wherein one or more of the one or more head tracking devices are arranged to be placed in an ear of a person.

6. The hair trimming device of claim 1, wherein the tracking system comprises a head tracking device configured to detect the position of the hair trimming device and the hair trimming device further comprises an area for storing, charging and/or identifying the head tracking device.

7. The hair trimming device of claim 1, comprising a user grip area and a distance comb separate from the user grip area, wherein the hair cutting mechanism comprises a cutting point that is adjustable with respect to the distance comb.

8. The hair trimming device of claim 1, further comprising:

a trimming motor coupled to the movable blade and configured to move the movable blade, wherein the processor is coupled to the trimming motor and is configured to start the trimming motor when the hair trimming device is placed in a start-up area on the head.

9. The hair trimming device of claim 1, wherein the individual position points are symmetrically positioned on both sides of the person's head and/or are positioned centered on the person's head.

10. The hair trimming device of claim 1, further comprising a computer system configured to enable retrieval, modification, visualization and storing of the hair length profile data, wherein the computer system is configured to enable a change to hair length that is applied to one or more of the various individual position points on the head.

11. The hair trimming device of claim 1, further comprising a computer system configured to monitor progress of a hair trimming session performed by the hair trimming device.

12. The hair trimming device of claim 1, wherein two or more of the individual position points comprise pairs of position points, wherein a first one of each pair is symmetrically positioned on the person's head with reference to a second one of each pair and/or one or more of the individual position points are positioned centered on the person's head.

13. The hair trimming device of claim 1, wherein the processor is further configured to limit local hair trimming length variation by the equation:

$Ly \geq sqr(Lx^2 - D^2)$, where Ly is a minimum length of a hair at a distance D from a longer hair with a length Lx.

14. A method of controlling a hair trimming device including a hair cutting mechanism to trim hair, the method comprising acts of:

calculating hair lengths for all positions that correspond to hair trimming positions on the head that do not correspond to various individual position points on the head based on previously generated hair length profile data that identifies a corresponding hair length only at the various individual position points guiding the hair trimming device on a head of a person on whom a hair trimming is being performed;

detecting positions on the head, wherein the detected positions correspond to individual position points on the head or do not correspond to the individual position points on the head; and while the hair cutting mechanism is guided on the head, dynamically adjusting a hair trimming length of the hair cutting mechanism automatically according to the detected positions and the calculated hair lengths for all the detected positions that correspond to hair trimming positions on the head other than the various individual position points, and while the hair cutting mechanism is guided on the head, dynamically adjusting the hair trimming length set by the length adjusting mechanism automatically to the corresponding hair length when any of the detected positions are one of the various individual position points.

15. The method of claim 14, further comprising an act of limiting local hair trimming length variation by the equation:

$Ly \geq sqr(Lx^2 - D^2)$, where Ly is a minimum length of a hair at a distance D from a longer hair with a length Lx.

16. A computer-readable non-transitory medium having stored software for causing a processor to perform the method of claim 14 for controlling a hair trimming device.

17. The computer-readable non-transitory medium according to claim 16, the method further comprising an act of adjusting local hair trimming length variation such that variations between the hair length profile data and the calculated hair lengths between the individual position point lengths forms a smooth Bezier curve.

18. The computer-readable non-transitory medium according to claim 16, wherein at least two of the individual position points are symmetrically positioned with reference to the person's head.

19. The computer-readable non-transitory medium according to claim 16, the individual position points consisting only of centered and symmetrically positioned pairs of position points about the centered position points with reference to the person's head.

20. The computer-readable non-transitory medium according to claim 16, the method further comprising acts of:

modifying the previously generated hair length profile data; and prompting a user where to add individual position points.

* * * * *